US005160133A

United States Patent [19]

Bloom

[11] Patent Number: 5,160,133

[45] Date of Patent: Nov. 3, 1992

[54] APPARATUS AND METHOD FOR PRESERVING A MARKSMANSHIP TARGET SCORE

[76] Inventor: Melvin R. Bloom, 49-561 Kam Hwy., Kaneohe, Hi. 96744

[21] Appl. No.: 568,971

[22] Filed: Aug. 17, 1990

[51] Int. Cl.[5] ..... F41D 1/00

[52] U.S. Cl. ..... 273/408; 434/81; 428/542.4

[58] Field of Search ..... 273/408; 434/81, 82, 434/83, 84; 428/542.4

[56] References Cited

U.S. PATENT DOCUMENTS

| | | | |
|---|---|---|---|
| 1,061,804 | 5/1913 | Bannan | 434/84 X |
| 2,984,488 | 5/1961 | Kirchner | 434/83 X |
| 4,810,561 | 3/1989 | King | 273/408 X |

*Primary Examiner*—William H. Grieb
*Attorney, Agent, or Firm*—Michael I. Kroll

[57] ABSTRACT

An apparatus for preserving a marksmanship target score is provided and consists of a thin target with a marked surface, a target board with a matching marked surface and a plurality of cartridge cases. The thin target is mounted on a rear wall of a target range and is shot at by a person holding a firearm so as to put holes through the thin target to test the accuracy in a firearm practice. When the thin target with the holes therethrough is removed from the rear wall of the target range and placed over the target board, the cartridge cases are driven through the holes in the thin target and into the target board so as to preserve the score on the target board.

1 Claim, 2 Drawing Sheets

APPARATUS AND METHOD FOR PRESERVING A MARKSMANSHIP TARGET SCORE

BACKGROUND OF THE INVENTION

1. Field of the Invention

The instant invention relates generally to targets and more specifically it relates to an apparatus and method for preserving a marksmanship target score.

2. Description of the Prior Art

Numerous targets have been provided in prior art that are adapted to be normally padded objects with marked surfaces, which are shot at in firearm practice, so as to indicate the scores received by the persons shooting the firearms. While these units may be suitable for the particular purpose to which they address, they would not be as suitable for the purposes of the present invention as heretofore described.

SUMMARY OF THE INVENTION

A primary object of the present invention is to provide an apparatus and method for preserving a marksmanship target score that will overcome the shortcomings of the prior art devices.

Another object is to provide an apparatus and method for preserving a marksmanship target score that will permanently transfer onto a matching target board the score received on a paper target by a person skilled at shooting a firearm.

An additional object is to provide an apparatus and method for preserving a marksmanship target score whereby the score is transferred by placing the paper target over the target board, then driving cartridge cases through the holes in the paper target into the target board so as to recreate the score thereon.

A further object is to provide an apparatus and method for preserving a marksmanship target score that is simple and easy to use.

A still further object is to provide an apparatus and method for preserving a marksmanship score that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
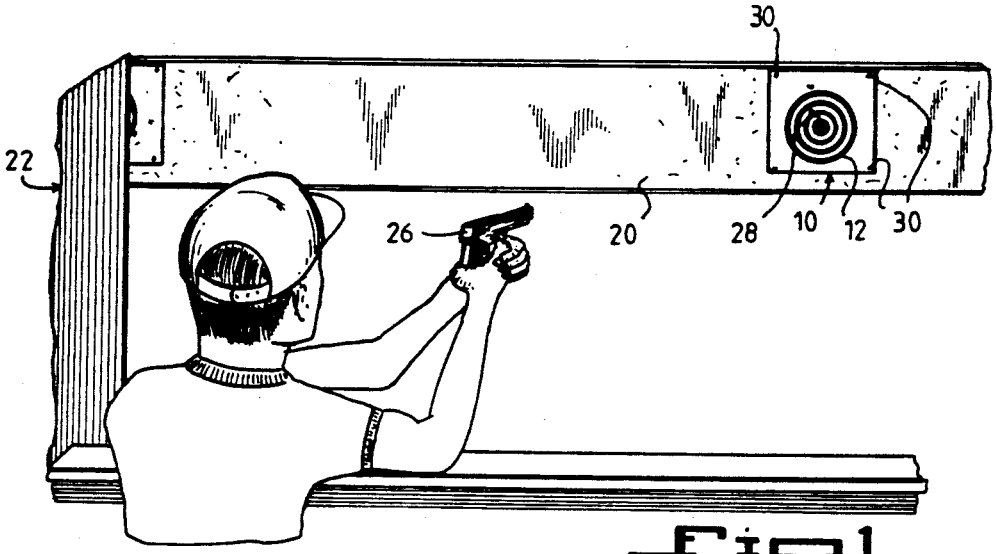
FIG. 1 is a perspective view of a person shooting a firearm at a paper target.

Turning now descriptively to the drawings, in which similar reference characters denote similar elements throughout the several views, the Figures illustrate an apparatus for preserving a marksmanship target score consisting of a thin target 10 with a marked surface 12, a target board 14 with a matching marked surface 16 and a plurality of cartridge cases 18.

The thin target 10 is mounted on a rear wall 20 of a target range 22, so that a person 24 holding a firearm 26 can shoot at the thin target 10 to put holes 28 through it to test the accuracy in a firearm practice. The thin target 10 with the holes 28 therethrough is then removed from the target range 22 and placed over the target board 14. The cartridge cases 18 are driven through the holes 28 in the thin target 10 and into the target board 14 so as to preserve the score on the target board 14.

The thin target 10 is square shaped and is made of cellulose pulp material, derived mainly from wood, rags and certain grasses which is processed into a flexible sheet by deposit from an aqueous suspension otherwise known as paper. The target board 14 is square shaped and is made of Phillipine mahogany plywood. Four fasteners 30, such as tacks, are also provided. Each fastener 30 is driven through one corner of the thin target 10 to mount the thin target on the rear wall 20 of the target range 22. The fasteners 30 also secure the thin target 10 onto the target board 14 before the cartridge cases 18 are driven through the holes 28 in the thin target 10 and into the target board 14.

An electric drill 32 can be utilized for transferring the holes 28 made in the thin target 10 into the target board 14, when the thin target 10 is placed over the target board 14 on the table 34, this is done by drilling holes 36 into the target board 14, so that the cartridge cases 18 can be easily driven into the target board. The cartridge cases 18 are driven partway into the target board 14 establishing a three dimensional effect when preserving the score on the target board 14.

Figure 2:
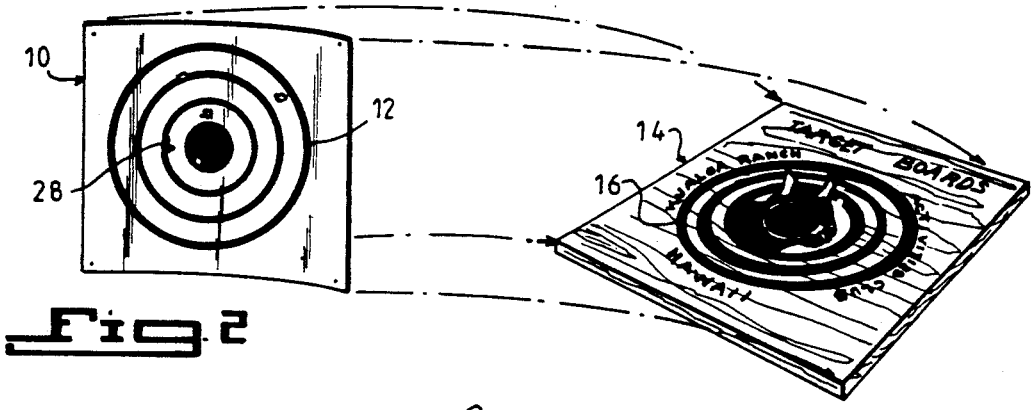
FIG. 2 is a perspective view showing the paper target with holes ready to be secured onto a matching target board.
Figure 3:
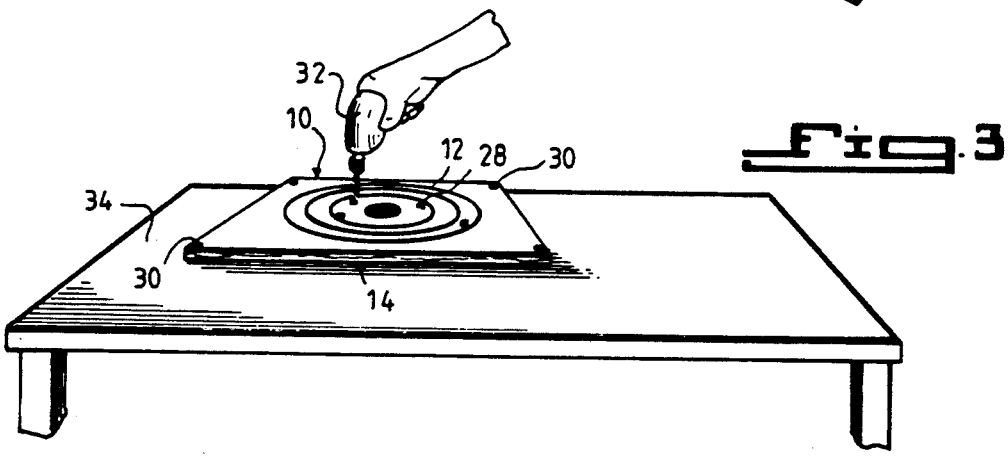
FIG. 3 is a perspective view of the paper target secured onto the target board on a table and a drill transferring the holes into the target board.
Figure 4:
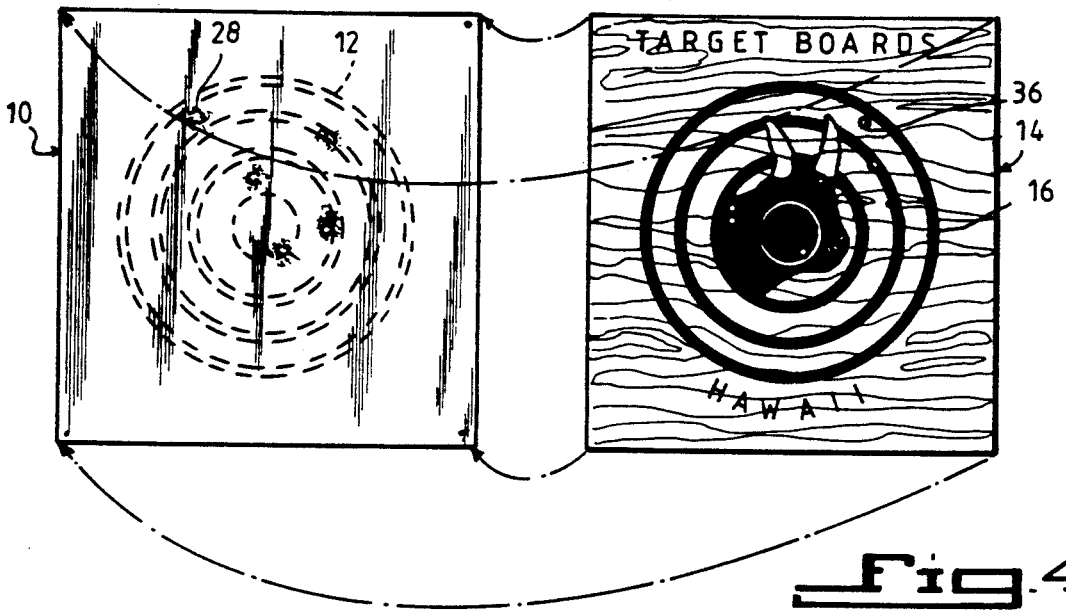
FIG. 4 is a plan view showing the paper target being removed from the target board with the transferred holes therein.
Figure 5:
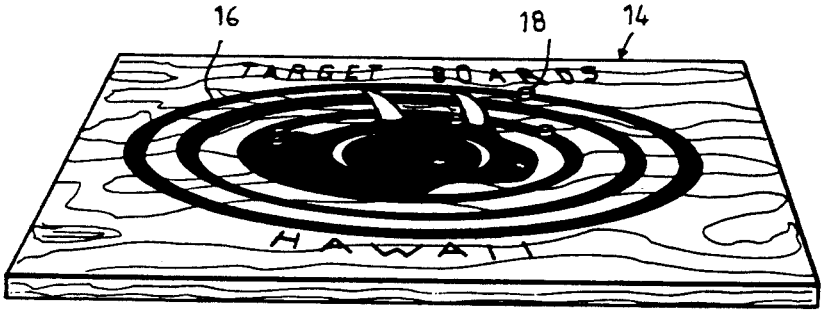
FIG. 5 is a perspective view of the target board with cartridge cases drive into the transferred holes therein.
Figure 6:
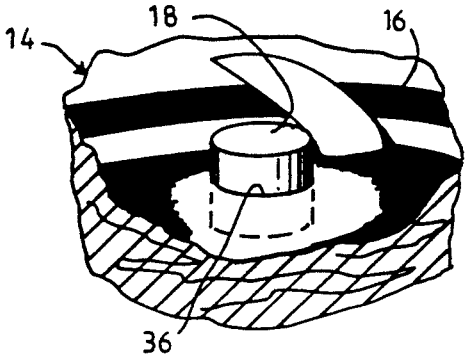
FIG. 6 is an enlarged perspective view of a portion of the target board showing one of the cartridge cases therein.

To preserve the marksmanship target score the following steps should be taken:

1. Shoot the firearm 26 at the thin target 10 with the marked surface 12 mounted on the rear wall 20 of the target range 22 (FIG. 1).
2. Place the thin target 10 with the shot holes 28 therethrough over the target board 14 with the matching marked surface 16 (FIG. 2).
3. Drill holes 36 into the target board 14 with the electric drill 32, through the shot holes 28 in the thin target 10 (FIG. 3).
4. Remove the thin target 10 with the shot holes 28 from the target board 14 with matching drilled holes 36 (FIG. 4).
5. Insert the cartridge cases 18 into the drilled holes 36 in the target board 14 partway to establish a three dimensional effect so as to preserve the score on the target board 14 (FIGS. 5 and 6).

The thin target 10 can be fabricated out of other thin materials such as plastic, fabric, metal, etc., while the target board 14 cans also be fabricated out of other durable materials such as plastic, other types of wood, metal, etc.

The target board 14 can be hung on a wall and displayed like a plaque to show and preserve the marksmanship target score receive by the person 24 who shot the firearm 26 in the target range 22.

LIST OF REFERENCE NUMBERS

10—thin target
12—marked surface on 10
14—target board
16—matching marked surface on 14
18—cartridge cases
20—rear wall
22—target range
24—person
26—firearm
28—holes in 10
30—fasteners
32—electric drill
34—table
36—drilled holes in 14

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A method for preserving a marksmanship target score, which comprises:

(a) shooting a firearm at a thin target with a marked surface mounted on a rear wall of a target range;
(b) placing the thin target with shot holes therethrough over a target board with a matching marked surface;
(c) drilling holes into the target board with an electric drill, through the shot holes in the thin target;
(d) removing the thin target with the shot holes from the target board with matching drilled holes; and
(e) inserting cartridge cases into the drilled holes in the target board part way to establish a three dimensional effect so as to preserve the score on the target board.

* * * * *